US006755717B2

(12) United States Patent
Smith

(10) Patent No.: US 6,755,717 B2
(45) Date of Patent: Jun. 29, 2004

(54) BRASSIERE, HALTER OR BRA GARMENT IMPROVED WITH LATERALLY ATTACHED, ADJUSTABLE ELASTIC BANDS FOR INERTIALLY RESTRAINING BREASTS

(76) Inventor: Veronica C. Smith, 1440 Regatta Blvd., Richmond, CA (US) 94804

( * ) Notice: Subject to any disclaimer, the term of this patent is extended or adjusted under 35 U.S.C. 154(b) by 0 days.

(21) Appl. No.: 10/032,457

(22) Filed: Jan. 2, 2002

(65) Prior Publication Data

US 2003/0134567 A1 Jul. 17, 2003

(51) Int. Cl.[7] ..... A41C 3/00
(52) U.S. Cl. ..... 450/1; 450/58; 128/869
(58) Field of Search ..... 450/1, 2, 3, 5, 450/7–10, 12–14, 17, 18, 23, 25, 26, 58, 59, 62, 63, 85; 128/869, 870, 873, 874, 90.1, 99.1, 100.1, 101.1; 602/41, 60, 61; 2/73, 78.1–78.3, 104–106, 69

(56) References Cited

U.S. PATENT DOCUMENTS 2,607,038 A * 8/1952 Spare ..... 450/58
2,662,522 A * 12/1953 Muller ..... 450/1
4,325,378 A * 4/1982 Wilkinson ..... 450/58
4,444,191 A * 4/1984 Harned ..... 450/1
4,741,719 A * 5/1988 Wirth ..... 450/30
4,781,651 A * 11/1988 Ekins ..... 450/79
5,037,348 A * 8/1991 Farino ..... 450/1
5,098,331 A * 3/1992 Corrado ..... 450/58
5,538,502 A * 7/1996 Johnstone ..... 602/79
5,868,601 A * 2/1999 Kelemencky ..... 450/59
6,168,498 B1 * 1/2001 Wagner ..... 450/58

* cited by examiner

*Primary Examiner*—Gloria M. Hale

(57) ABSTRACT

An improvement for a typical brassiere, halter or bra garment comprises a pair of wide, unidirectional elastic, plush pile, fabric breast bands each affixed to a lateral side section of the garment on opposite sides of the person's thoracic torso. Hook fastener material is secured transversely across to the exterior surface at the distal of one breast band, and transversely across to the interior surface at the distal end of the other breast band for allowing a wearer, alternatively, (i) to secure the breast bands together in an overlapping fashion across her front torso over the upper (pole) portion of her breasts for restraining upward movement of breast mass and any associated implants, or (ii) to secure the breast bands together in an overlapping fashion across her back torso when such upward restraint is not desired.

5 Claims, 2 Drawing Sheets

BRASSIERE, HALTER OR BRA GARMENT IMPROVED WITH LATERALLY ATTACHED, ADJUSTABLE ELASTIC BANDS FOR INERTIALLY RESTRAINING BREASTS

BACKGROUND OF THE INVENTION

1. Field of the Invention

This invention relates generally to bras for positioning and stabilizing breast implants post-operatively and for restraining vertical (inertial) bounce of breast tissue during times of vigorous physical activity.

2. Background of the Invention

A woman's breast are composed predominantly of malleable fatty tissues supported by skin tissue and ligaments. Both the supporting skin tissue and the ligaments are somewhat elastic and do stretch. However, the elastic response of the supporting skin tissue and ligaments deteriorates with undue, or excessive stress, and with age.

Historically, since the late 1800s women have used brassieres (bras) to prevent undue or excessive stress on the supporting skin and ligament due to the mass or weight of their breasts. Such typical brassieres are adequate for "everyday" relative sedate activities. However typical bras are neither designed for providing the support, nor the restraint needed to position and stabilize breast implants post-operatively. In particular, normal bras allow disfiguring upward migration of breast implants.

Sports bras and halters designed for restraining and protecting women's breasts against excessive stress during times of vigorous physical activity have been typically based on one or two underlying principles: encapsulation and compression. Encapsulation bras seek to firmly and individually confine each breast within a cup-like structure, and have a disadvantage of chafing with torso movement. Compression bras are essentially designed to force or 'compress' the breasts against the chest wall as a single mass, and are neither comfortable nor suited for big breasted women.

SUMMARY OF THE INVENTION

The present invention is an improved brassiere, halter or bra having a pair of laterally affixed, wide, unidirectional elastic, plush pile, fabric breast bands each with hook fastener material at its distal end for engaging the plush pile fabric of the other band allowing a wearer, alternatively, either to secure the breast bands together in an overlapping fashion across her front thoracic torso over the upper portion of her breasts for adjustably restraining upward movement of breast tissue and any associated implants, or to secure the breast bands together in an overlapping fashion across her back torso when such upward restraint is not required.

In more detail, a pair of wide, unidirectional elastic, plush pile, fabric breast bands each with hook fastener material across its distal end are permanently secured (stitched to) forming seams at opposite left and right lateral side sections of a typical brassiere or bra. The breast bands have a relaxed (unstretched) length less than half the minimum circumference of the brassiere/halter/bra and a stretched length at most equal to the circumferential distance between the respective seams securing the breast bands on opposite sides of the garment. The wearer overlaps and fastens the wide, unidirectional elastic, plush pile, fabric breast bands together over the upper surfaces of her breast to provide, and adjust, an elastic force urging each breast downward and laterally against her underlying muscle tissue (pectoralis major) on her chest wall without significantly constricting circulation or breathing.

A significant advantage of the invented improved brassiere, halter or bra is that the wearer can also overlap and fasten the wide, unidirectional elastic, plush pile, fabric breast bands across her back when restraining downward restraint of the breast is not needed or desired. In this instance the overlap of the breast bands can be adjusted to comfortably provide an enhanced elastic response for conventional support of the breasts as well as aid distribution of forces due to breast mass or weight to and around the woman's thoracic torso.

Another significant feature of the invented improvement for brassiere, halter or bra is that the hook fastener material extends perpendicularly across its width at the distal ends of the wide, unidirectional elastic, plush pile, fabric breast bands allowing for adjustment of both the orientation of, and the overlap of the breast bands to provide restraining elastic forces, which, in combination with those provided by support components of conventional bra structures, are ideal for stabilizing and positioning breast implants post-operatively, i.e., to prevent upward migration breast implants and a resulting disfiguring displacement of the inframammary skinfold or crease, i.e., the skinfold under the breast constituting the transition between a woman's breasts and her thoracic cage.

Another feature of the invented improvement for brassiere, halter or bra is that in 'sports' or exercise surroundings, the pair of wide, unidirectional elastic, plush pile, fabric breast bands secured (stitched) forming seams at opposite left and right lateral sides of a conventional sports bra or jogging halter, allow the wearer to modestly adjust the degree restraint necessary to prevent, undue, possibly painful breast bounce during exercise or strenuous physical activity.

Another aspect of the invented improvement for brassiere, halter or bra relates to creation of a design mechanism enabling fine tuning of the restraining and supporting forces provided by the unidirectional elastic response of the wide, plush pile, breast bands in combination with the underlying brassier/bra structure. In particular, the lateral seam anchoring the respective breast bands can be oriented relative to both the unidirectional elastic response of the breast bands and the elastic response of the lateral sections of the brassiere/halter/bra to provide a desired distribution of forces.

The adjustability of wide, unidirectional elastic, plush pile, fabric breast bands of the invented improved bra or brassiere renders it equally suited for both smaller and larger breasted women. In particular, when overlapped and secured across a woman's front thoracic torso over the upper portion of her breasts, the wide, unidirectional elastic, plush pile, fabric breast bands urge the base of the breast and associated conically rising tissue downward and inward which, in combination with the base/torso band of a conventional brassiere or bra encircling the torso just below the inframammary crease, works to extrude and confine the conically rising breast tissue in the cup of the brassiere or bra, hopefully chosen to be adequate to receive the breast mass.

Still other objects, features aspects and advantages of the invention will become apparent from the following description, taken in connection with the accompanying drawings, wherein, by way of illustration and example, an embodiment of a preferred embodiment of the present invention is disclosed.

DESCRIPTION OF PREFERRED AND EXEMPLARY EMBODIMENTS

Figure 1:
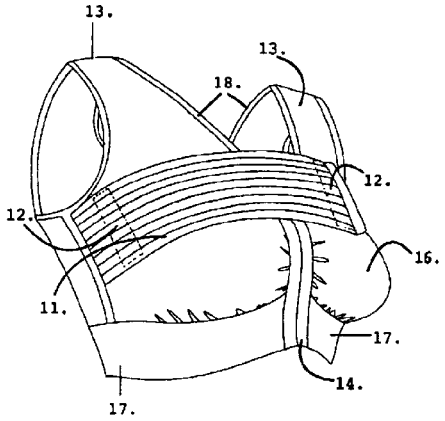
FIG. 1 is a slightly different right front perspective rendering of the invented improved brassiere again illustrating the overlapping engagement of the wide, unidirectional elastic, plush pile, fabric breast bands or bra across the front torso over the upper portion of a woman's breasts.
Figure 2:
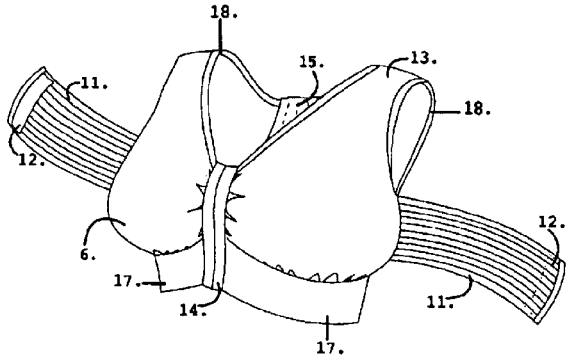
FIG. 2 is a left front perspective rendering of the invented improved brassiere with the wide, unidirectional elastic, plush pile, fabric breast bands disengaged showing details of the underlying brassiere.
Figure 3:
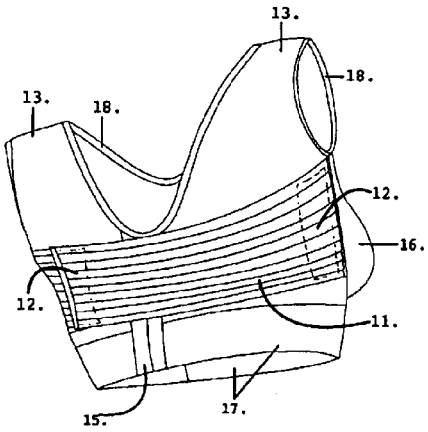
FIG. 3 is a left rear perspective rendering of the invented improved brassiere illustrating overlapping engagement of the wide, unidirectional elastic, plush pile, fabric breast bands across the back torso of a woman's thorax.
Figure 4:
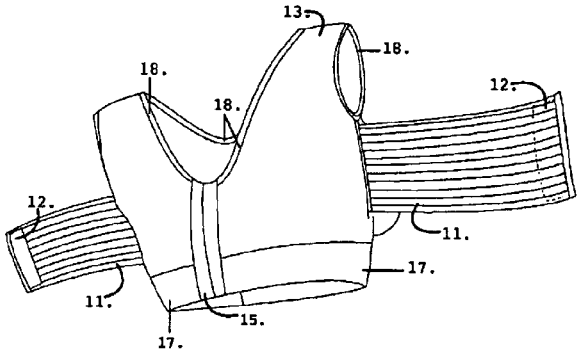
FIG. 4 is a left rear perspective rendering of the invented improved brassiere with the wide, unidirectional elastic, plush pile, fabric breast bands disengaged again showing details of the underlying brassiere.
Figure 1A:
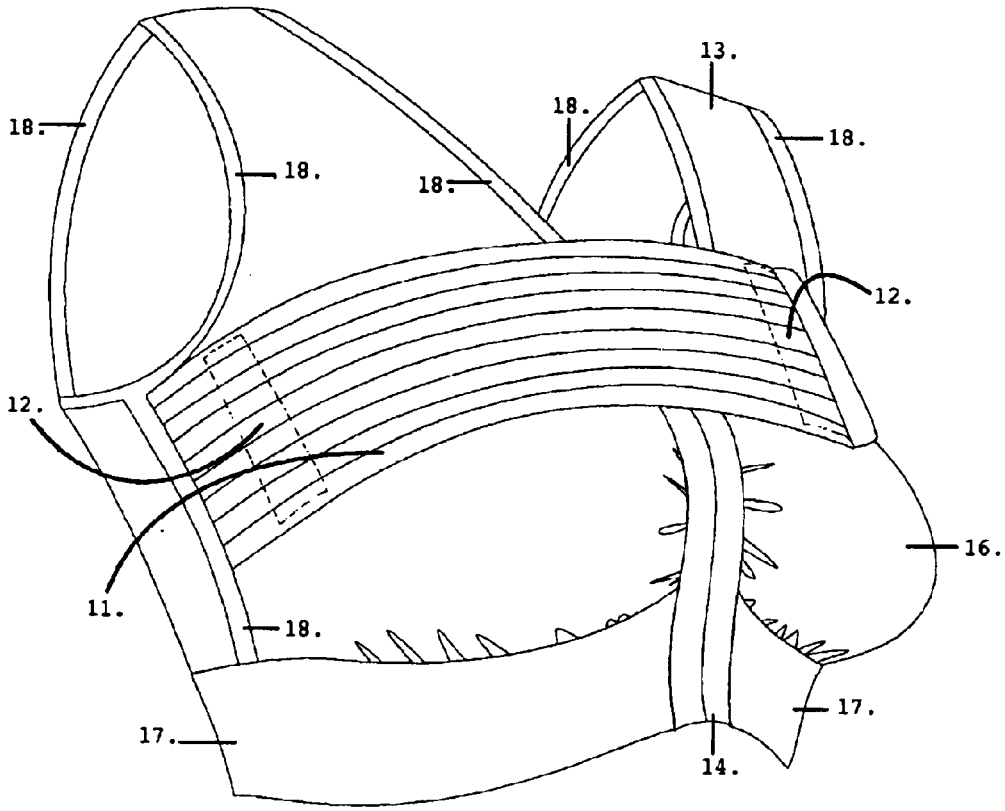
FIG. 1A is a right front perspective rendering of the invented improved brassiere illustrating the overlapping engagement of the wide, unidirectional elastic, plush pile, fabric breast bands or bra across the front torso over the upper portion of a woman's breasts.

Looking at the drawings, with particular attention to FIGS. 2 and 4, a typical brassiere, halter or bra garment 16 may include, in combination:

(i) a vertically oriented, inelastic, front closure structure 14 such as a vertical row, respectively of hooks and eyes each sewn or incorporated into an inelastic edge seam adapted for joining left and right front sections of the brassiere/halter/bra garment 16 centrally between a woman's breasts (not shown);

(ii) a vertically oriented, inelastic, back closure structure 15 such as a vertical row of hooks sewn or incorporated into an edge seam of one of the back sections of the brassiere/halter/bra garment 16 and a plurality spaced vertical rows of eyes sewn or incorporated into a wide inelastic edge seam of the other of the rear sections of the brassiere/halter/bra garment 16 adapted for joining the left and right back sections of the brassiere/halter/bra garment 16 together;

(iii) a base or torso band 17 for snuggly, preferably elastically, encircling the woman's thoracic torso with the upper or top edge of the band 17 vertically located on a woman's front thoracic torso at or slightly below the inframammary crease;

(iv) lateral or side sections respectively joining the right, front and back and the left, front and back sections of the brassiere/halter/bra garment 16 together laterally around the woman's thoracic torso under her arms; and (v) shoulder straps 13 respectively joining the right, front and back and the left, front and back sections of the brassiere/halter/bra garment 16 together over the woman's shoulders.

As illustrated in the drawings, the respective right and left front sections, back sections, lateral sections, and shoulder straps 13 of the brassiere/halter/bra garments 16 are each shown as a single or unitary piece of a relatively flexible, bidirectional 'stretchy' material such as nylon spandex which yields slightly, elastically, in all directions in the fabric plane, framed by a stronger, unidirectional elastic, reinforcing seam material 18 that elastically yields slightly only longitudinally in the direction of the seam. The base or torso band 17 is formed in left and right sections of a strong, wider, unidirectional elastic band each seamed along its upper edge respectively, to the right and left, front, lateral and back sections of the brassiere/halter/bra 16. The ends of the respective sections of the base/torso band 18 are incorporated into and terminate at the edge seams of the front and back closure structures 14 and 15. The unidirectional elastic response of the bands forming the base/torso band 17 is longitudinal aligned with the band not horizontally across the band.

While not shown in the drawings, the shoulder straps 13 of such brassieres/halters/bras 16 typically are adjustable, allowing a wearer to establish and adjust the vertical position of the base or torso band 17 around her thoracic torso to a comfortable point below her inframammary skinfold. There are many different types of mechanisms for adjusting the shoulder straps 13. One particularly suited for the brassiere/halter/bra garments 16 of the type illustrated, would be a strap formed or joined by a Velcro® system with, for example, hook fastener material secured (sewn) to a tab end of a front shoulder strap section, overlying and engaging a longitudinal section of pile or loop material secured (sewn) down the length of the strap from an end of a back shoulder strap section.

The invented improvement to such a typical brassiere/halter/bra 16, comprises a pair of laterally affixed, wide, unidirectional elastic, plush pile, fabric breast bands 11 each with hook fastener material 12 secured (sewn) transversely across its distal end for engaging the plush pile fabric of the other band. The hook fastener material 12 is secured on the exterior surface of one breast band 11 and on the interior surface of the other breast band 11 allowing a wearer, alternatively, either to secure the breast bands 11 together in an overlapping fashion across her front torso over the upper portion of her breasts for restraining upward movement of breast mass and any associated implants, or to secure the breast bands together in an overlapping fashion across her back torso when such upward restraint is not required, or desired. In particular, the breast bands 11 are preferably, rectangular strips of a unidirectional elastic textile material having plush or pile (plush pile) on both surfaces (interior and exterior) that can engage or fasten to hook fastener material. (See U.S. Pat. No. 2,717,437, G. de Mestral.)

The respective breast bands 12 should have a relaxed (unstretched) length less than half the minimum circumference of the brassiere/halter/bra garment 16 and a stretched length at most equal to the circumferential distance between the respective seams securing the breast bands 16 to the opposite lateral side sections of the brassiere/halter/bra 16. However, as discussed below the unidirectional elastic response of the particular material of the breast bands 11 will actually determine a desired ratio of relax to stretched length of the bands 11. The basic idea is to provide the wearer with the ability to vary the range of tension of the stretched bands 11 by varying the degree of overlap of the bands across her front thoracic torso over the upper section of her breasts as necessary to restrain and dampen upward inertial bounce of breast tissue independent of her underlying thoracic cage.

The width of the breast bands 11 can range from 2 inches to 4½ inches and even wider for very large, massive breasted women. In any case, for any particular brassiere/halter/bra cup size or configuration, the width of the breast bands 11 should be chosen to be sufficient to span from the top base or upper junction of the breasts with the thoracic cage smoothly downward across approximately the upper third of each conically pyramiding breasts toward the nipple when the breast bands 11 are engaged in an overlapping fashion across the woman's upper front torso for retraining upward movement of the breast mass. The desired goal is for the overlapping, engaged breast bands 11 to provide a force for urging (extruding) the malleable breast masses downward into the slightly expansible breast cups formed by the respective left and right front sections of the brassiere/halter/bra 16. The breast cups are anchored at a vertical position on the woman's thoracic cage by the combination of the base or torso band 17 and the shoulder straps 13 of the brassiere/halter/bra. When so confined, by the combination of the overlapping, engaged breast bands 11 and the structural support elements of a typical brassiere/halter/bra 16, the breast masses inertially move with, rather than independent of the woman's thoracic torso. On the other hand, the breast bands 11 should not be so wide that the overlapping bands simply squash the breast mass against the underlying muscle tissue and chest wall causing or allowing the brassiere/halter/bra garment 16 and associated breast bands 11 to float on the breast mass above the woman's thoracic torso.

The idea is for the breast bands 11 to mechanically anchor or couple the upper portion of the breast masses to the woman's thoracic torso, and for the encircling base/torso band 17, in combination with the shoulder straps 13, to mechanically anchor or couple lower portion of the breast masses to the woman's thoracic torso. The respective left and right, front and lateral sections of the brassiere/halter/bra garment 16, being composed of a relatively flexible, bidirectional 'stretchy' material elastically expands slightly to accommodated the additional beast mass. The limited elastic response of left and right, front and lateral sections of the brassiere/halter/bra garment 16 receiving the breast mass also effectively limits and dissipates/dampens inertial bounce of the breast masses between the overlapping, engaged breast bands and base/torso band 17.

Both for reasons of health and comfort, the invented, improving wide, unidirectional elastic, plush pile, fabric breast bands 11 should not be a conventional, tightly woven, unidirectional elastic textile material, but rather a breathable unidirectional elastic, textile material that allows air circulation and cooling vaporization of perspiration (See for example, U.S. Pat. Nos. 4,344,999, D. J. Gohlke; 5,695,868, A. L. McCormack and related art.)

An example of a suitable unidirectional elastic, textile material for the breast bands 11 would be a plurality of spaced apart parallel, spandex (elastane) plush pile fiber strips woven/bonded onto an array of transversely oriented, closely spaced, nylon monofilaments to form a band. A producer of such spandex fiber (elastane) is Dupont® Textiles and Interiors.

As described in the art, spandex fiber (elastane) is, . . . "a polymer chain that is a segmented block copolymer containing long, randomly coiled, liquid, soft segments that move to a more linear, lower entropy, structure. The hard segments act as "virtual cross-links" that tie all the polymer chains together into an infinite network. This network prevents the polymer chains from slipping past each other and taking on a permanent set or draw. When the stretching force is removed, the linear, low entropy, soft segments move back to the preferred randomly coiled, higher entropy state, causing the fiber to recover to its original shape and length. Such segmented block copolymer is formed in a multi-step proprietary process. It is extruded into a fiber as a monofilament threadline or for most products into a multiplicity of fine filaments that are coalesced shortly after they are formed into a single threadline."

Essentially, the elastic response of such woven/bonded spandex fiber, plush pile strips is unidirectional in the longitudinal direction of the strips.

Like the spandex, plush pile fiber strips, the breast bands 11 elastically stretch longitudinally but not transversely. However, the skilled practitioner, should realize, that the unidirectional longitudinal elastic response of the breast band only means that the transverse dimension or width of the band does not significantly change (elastically) as the band stretches longitudinally around contours presented by a woman's thoracic torso and associated breasts. However, a consequence is that the tensile force varies transversely across the stretched band as a function of that contour. This means that a skilled brassiere/halter/bra designer can orient and position the transverse seams 19 securing/anchoring the respective breast bands 11 on the lateral side sections of typical brassiere/halter/bra garments 16 to achieve a desired distribution of forces (in combination with the other structural and elastic forming elements of the particular brassiere/halter/bra) for urging, shaping and restraining (locating) one or the other of a woman's breast masses on her thoracic torso. It also means that the wearer can adjust the engagement orientation of the respective transverse strips of hook fastener material 11 at the distal ends of each breast band 11 across spandex fiber, plush pile strips of other breast band 11 for a 'sensed' comfort level and effectiveness of restraint for her particular thoracic torso for the chosen activity.

The invented improving pair of laterally affixed, wide, unidirectional elastic, plush pile, fabric breast bands 11 for typical brassiere/halter/bra garments 16 is also ideally suited for confining and restraining breast implants post-operatively. As pointed out by F. G. Farino in U.S. Pat. No. 5,037,348 and M. W. Corrado in U.S. Pat. No. 5,098,331, forces created by an encircling therapeutic brassiere structures can be, and are used to position and restrain implants within the breast mass. Corrado even describes an additional ". . . body encircling strip 58 for exerting pressure on the upper surface 60 of the breasts 62 by pressing them toward the chest of the patient . . . " for postoperative movement and distortion of the breast mass with implant installed. In particular, the invented improvement for brassiere/halter/bra garment 16 of a pair of laterally affixed, wide, unidirectional elastic, plush pile, fabric breast bands 11 each with hook fastener material 11 secured (sewn) transversely across its distal end for engaging the plush pile fabric of the other band affixed (seamed) oppositely to the lateral side sections of the garment 16, permit the surgeon, the caregiver and the patient to easily adjust the degree of confining tension across the patients upper thoracic torso by choosing the vertical position of, as well as the degree of overlap of the breast bands the over the upper sections or poles of the respective breasts to achieve a desired configuration of forces (transmitted by overlying breast tissues) for positioning and holding an implant in position post-operatively.

Also, as illustrated in the drawings, typical brassiere/halter/bra garments 16 may have separate left and right, front, lateral/side and back sections. Woman's breasts are seldom exact mirror reflections of each other, i.e., seldom have exact parity. In instances where one breast is reconstructed, the breasts will not even exhibit similar inertial responses to movement of the thoracic torso. Accordingly, it is an advantage for a woman to be able to 'mix and match' left and right, (two piece) front, lateral/side and back sections of a brassiere/halter/bra garment 16 to her particular left and right breasts. The invented improving pair of, wide, unidirectional elastic, plush pile, fabric breast bands 11 laterally affixed to the respective lateral/side sections of the brassiere/halter/bra garment 16 adds greatly, to both the flexibility and the advantages of such two piece brassiere/halter/bra garment systems.

As described the invented improvement of a pair of wide, unidirectional elastic, plush pile, fabric breast bands 11 affixed to opposite lateral sides of typical brassiere/halter/bra garments each with hook fastener material 12 secured (sewn) transversely across its distal end for engaging the plush pile fabric of the other band allowing the bands to fasten together in an overlapping fashion, can be adapted to many different confirmations and variations of such breast confining garments. The specific details disclosed herein are not to be interpreted as limiting, but rather as exemplary and directed to design factors to be considered by those skilled in the art for creating preferred designs for such garments.

I claim:

1. In a brassiere, halter or bra garment, including, a) a left and a right garment piece each having, (i) a front section, (ii) a back section, and (iii) a lateral side section for joining the front and back sections under an arm of a woman's thoracic torso;

b) a vertically oriented front closure structure incorporated into an inelastic, edge seam of each front section having means for fastening the respective left and right front sections of the garment pieces together;

c) a vertically oriented back closure structure incorporated into an inelastic, edge seam of each back section having means for adjustably fastening the respective left and right back sections of the garment pieces together;

d) an unidirectional elastic, base torso band for encircling the woman's thoracic torso below her inframammary skinfolds formed in two sections each having an upper edge seamed to a bottom edge of one of the left and right garment pieces and having distal ends terminating and seamed respectively to the front and back closure structure; and e) shoulder straps respectively, adjustably joining the front and back sections of the left and right garment pieces together over the woman's shoulders, an improvement comprising in combination therewith, a pair of wide, unidirectional elastic, plush pile, fabric breast bands each having one end affixed by a seam to a lateral side section of one of the left and right garment pieces and a free distal end with hook fastener material secured transversely across the band for engaging the plush pile fabric of the other band, the hook fastener material being on an outside surface of one breast band and on an inside surface of the other breast band for allowing the woman, alternatively, to secure the breast bands together in an overlapping fashion across her front thoracic torso over upper portions of her breasts for adjustably restraining upward inertial movement of her breast mass and any associated breast implants independent of her thoracic torso, and to secure the breast bands together in an overlapping fashion across her back thoracic torso when such upward restraint is not desired.

2. The improvement for a brassiere, halter or bra garment of claim 1 wherein each breast band has a relaxed unstretched length less than half a minimum circumference of the two piece garment and a stretched length at most equal to a circumferential distance between the respective seams securing the breast bands to the lateral side sections of the garment.

3. The improvement for a brassiere, halter or bra garment of claim 2 wherein each breast band has a unidirectional elastic response directed longitudinally along the length of the band.

4. The improvement for a brassiere, halter or bra garment of claim 1 wherein each breast band has a width of at least two inches.

5. The improvement for a brassiere, halter or bra garment of claim 4 wherein each breast band has a width of at most of 5 inches.

* * * * *